US006818849B2

(12) United States Patent
Itou et al.

(10) Patent No.: US 6,818,849 B2
(45) Date of Patent: Nov. 16, 2004

(54) APPARATUS AND METHOD FOR DETECTING ABNORMAL BALLS

(75) Inventors: Motoyuki Itou, Saitama-ken (JP); Takuji Ueda, Saitama-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 286 days.

(21) Appl. No.: 10/094,727

(22) Filed: Mar. 12, 2002

(65) Prior Publication Data

US 2002/0139730 A1 Oct. 3, 2002

(30) Foreign Application Priority Data

Mar. 13, 2001 (JP) ..... 2001-070624
Jul. 17, 2001 (JP) ..... 2001-216060
Feb. 27, 2002 (JP) ..... 2002-050648

(51) Int. Cl.[7] ..... B07C 5/12
(52) U.S. Cl. ..... 209/586; 209/587; 209/577
(58) Field of Search ..... 209/577, 586, 209/587, 686, 919, 546

(56) References Cited

U.S. PATENT DOCUMENTS 2,354,628 A * 7/1944 Whitesell, Jr. ..... 324/216
3,187,893 A * 6/1965 Silverman ..... 209/562
3,565,248 A * 2/1971 Sebastian et al. ..... 209/3.1

FOREIGN PATENT DOCUMENTS

JP 10-122832 5/1998
JP 11-128845 5/1999
JP 11-297774 10/1999
JP 11-319722 11/1999
JP 11-319728 11/1999

* cited by examiner

*Primary Examiner*—Donald P. Walsh
*Assistant Examiner*—Kaitlin Joerger
(74) *Attorney, Agent, or Firm*—Finnegan, Henderson, Farabow, Garrett & Dunner, L.L.P.

(57) ABSTRACT

An apparatus for detecting and removing abnormal balls among a large number of balls, most of which are good separate balls, comprising (a) a rotatable, cylindrical, ball-holding means comprising a large number of ball-receiving cavities each receiving one ball; (b) a means for detecting part of a ball projecting from each ball-receiving cavity in a detection region substantially at a top of the cylindrical ball-holding means; (c) a ball-supplying means disposed on the cylindrical ball-holding means upstream of the detection region; (d) an abnormal ball-removing means disposed downstream of the detection region on the cylindrical ball-holding means; (e) a means for collecting good separate balls downstream of the detection region; and (f) a means for carrying out the determination of abnormal balls based on the detection information of projecting portions of the balls obtained by the projecting ball-detecting means.

15 Claims, 9 Drawing Sheets

APPARATUS AND METHOD FOR DETECTING ABNORMAL BALLS

FIELD OF THE INVENTION

The present invention relates to an apparatus and a method for detecting abnormal balls such as connected balls, etc. among a large number of small balls, most of which are separate balls.

PRIOR ART

Small balls made of metals, resins or glass, etc. and required to have high sphericity are produced from melts by various methods. For instance, small metal balls such as solder balls are produced by ejecting and cooling a molten metal in a gas or a solvent. This production method, however, forms abnormal balls, such as connected balls constituted by a plurality of balls, balls having sizes outside the permitted range, balls having sphericity outside the permitted range, for instance, ellipsoids, etc., in addition to good separate balls within the predetermined ranges of size and sphericity. Though most of balls outside the permitted size range can be removed by a sieve, for instance, connected balls, which may have the same diameters as those of separate balls depending on their directions, pass through sieve openings, it is impossible to completely remove all the connected balls from a large number of separate balls. Accordingly, the connected balls should be detected among a large number of balls and removed therefrom.

Conventionally used to detect connected balls among a large number of small balls is a so-called slope rolling method as described in, for instance, Japanese Patent Laid-Open No. 11-319728. This method utilizes the fact that good separate balls and connected balls fall differently when rolling down on a slope. This method is advantageous in that it can be conducted by an apparatus having a simple structure. However, this method is disadvantageous in that connected different-diameter balls cannot necessarily be detected with high precision, though connected balls having the same diameter can be detected with high precision.

Proposed by Japanese Patent Laid-Open No. 11-319722 to detect good separate balls and connected different-diameter balls with high precision is an apparatus comprising a member having a slanting surface on which a large number of small balls roll down, a means for supplying a large number of small balls to the slanting surface, a means for collecting good separate balls rolling down the slanting surface, and grooves in parallel with the rolling direction of the balls between the supply means and the slanting surface and/or on the slanting surface. Though the good separate balls continue rolling down even when entering into the grooves, the connected different-diameter balls entering into the grooves do not roll down, because their center axes are in alignment with the rolling direction, whereby small-diameter balls act as wedges between the grooves and large-diameter balls.

In the above apparatus comprising slanting grooves, however, the slanting angle, shape, size, etc. of the grooves affecting the detecting precision of connected balls should be detected depend on balls to be detected. This apparatus thus fails to detect abnormal balls efficiently. In addition, the produced balls contain not only connected identical-diameter balls constituted by a plurality of balls having substantially the same size, but also connected different-diameter balls having extremely small balls connected. Though connected identical-diameter balls fall with their center axes without alignment with the rolling direction, a wedge action does not work even though their center axes are in alignment with the rolling direction. Also, the connected different-diameter balls include those behaving similarly to good separate balls, in which only large-diameter balls roll down. Further, there are connected balls that fall along the slanting grooves without stopping. Accordingly, it is difficult to detect the connected balls among a large number of small balls with high precision by the above apparatus.

OBJECT OF THE INVENTION

Accordingly, an object of the present invention is to provide an apparatus and a method for detecting abnormal balls such as connected balls, etc. among a large number of small balls with high precision.

SUMMARY OF THE INVENTION

The apparatus for detecting abnormal balls among a large number of balls, most of which are good separate balls, according to one embodiment of the present invention comprises a ball-holding means having a large number of ball-receiving cavities each receiving one ball, and a means for detecting part of a ball projecting from each ball-receiving cavity, the determination of the abnormal balls being carried out by utilizing the detection information of projecting portions of the balls.

The apparatus for detecting abnormal balls among a large number of balls, most of which are good separate balls, according to another embodiment of the present invention comprises a ball-holding means having a large number of ball-receiving cavities each receiving one ball, a means for detecting part of a ball projecting from each ball-receiving cavity, and a means for carrying out the determination of abnormal balls based on the detection information of projecting portions of the balls.

The abnormal ball-detecting apparatus of the present invention further comprises a means for separating balls determined as abnormal balls from good separate balls.

The ball-receiving cavity preferably has a depth substantially equal to and a diameter slightly larger than the diameter of each good separate ball.

The ball-receiving cavities may be formed directly in the support member, or may be formed by a combination of a member having through-holes and a support member having a flat surface. Good separate balls are preferably supported by the bottom of the ball-receiving cavities, with their top points in the same plane as the upper edges of the ball-receiving cavities.

The ball-holding means is preferably formed by attaching an apertured sheet member to an outer surface of a cylindrical support member. Specifically, the ball-holding means comprises an apertured sheet member having a thickness substantially equal to the diameter of each separate good ball and through-holes each having as large a diameter as 1 to 1.2 times the diameter of each separate good ball, and a support member having a flat surface attached to the apertured sheet member, the ball-receiving cavities being formed by the through-holes of the apertured sheet member and the support member. Here, "substantially the same as the diameter of a separate ball" means that a ball has a diameter in a range of the nominal diameter of a separate ball plus such permitted error ranges as the dimensional tolerance of a separate ball, the formation error of a ball-receiving cavity, etc.

According to one embodiment of the present invention, the projecting ball-detecting means comprises a light source for emitting a light beam toward the ball-receiving cavities, and a light receptor for receiving a light beam passing over the surface of each ball-receiving cavity, and when part of a ball is projecting from a ball-receiving cavity, the light beam is intercepted thereby detecting that the ball is projecting from the surface of the ball-receiving cavity.

According to another embodiment of the present invention, the projecting ball-detecting means comprises a light source for emitting a light beam toward the ball-receiving cavities, and a light receptor for receiving a light beam reflected from part of a ball projecting from a ball-receiving cavity, thereby detecting that the ball is projecting from the surface of the ball-receiving cavity.

The method for detecting abnormal balls among a large number of balls, most of which are good separate balls, according to one embodiment of the present invention comprises introducing balls into cavities each having a predetermined depth, optically detecting part of a ball projecting from each cavity, and carrying out the determination of abnormal balls by a determination logic utilizing detection information of the balls.

The method for detecting abnormal balls among a large number of balls, most of which are good separate balls, according to another embodiment of the present invention comprises introducing balls into cavities each having substantially the same depth as the diameter of each separate good ball; optically detecting part of a ball projecting from the cavity; and determining balls projecting more than a reference level as abnormal balls.

The apparatus for detecting and removing abnormal balls among a large number of balls, most of which are separate good balls, according to a further embodiment of the present invention comprises (a) a rotatable, cylindrical, ball-holding means comprising a large number of ball-receiving cavities each receiving one ball; (b) a means for detecting part of a ball projecting from each ball-receiving cavity in a detection region substantially at a top of the cylindrical ball-holding means; (c) a ball-supplying means disposed upstream of the detection region on the cylindrical ball-holding means; (d) an abnormal ball-removing means disposed on the cylindrical ball-holding means downstream of the detection region; (e) a means for collecting good separate balls disposed downstream of the detection region; and (f) a means for carrying out the determination of abnormal balls based on the detection information of projecting portions of the balls obtained by the projecting ball-detecting means.

The apparatus for detecting and removing abnormal balls among a large number of balls, most of which are good separate balls, according to a further embodiment of the present invention comprises (a) a rotatable, cylindrical, ball-holding means comprising a large number of ball-receiving cavities each receiving one ball, the air being movable through the ball-receiving cavities between the inside and outside of the cylindrical ball-holding means; (b) a stationary member having three rib portions disposed inside the cylindrical ball-holding means, each rib portion being in contact with the inner surface of the cylindrical ball-holding means in a substantially air-tight manner, a reduced-pressure region defined by a first rib portion, a second rib portion and the inner surface of the cylindrical ball-holding means being disposed in an upper portion of the cylindrical ball-holding means, an atmospheric-pressure region defined by a second rib portion, a third rib portion and the inner surface of the cylindrical ball-holding means being disposed downstream of the reduced-pressure region, and a high-pressure region defined by a third rib portion, a first rib portion and the inner surface of the cylindrical ball-holding means being disposed in a lower part of the cylindrical ball-holding means downstream of the atmospheric pressure region; (c) a means for detecting part of a ball projecting from each ball-receiving cavity substantially at a top of the cylindrical ball-holding means in a detection region disposed in the reduced-pressure region; (d) a ball-supplying means disposed on the cylindrical ball-holding means upstream of the detection region in the reduced-pressure region; (e) an abnormal ball-removing means disposed on the cylindrical ball-holding means downstream of the detection region in the atmospheric pressure region; (f) a means for collecting good separate balls disposed downstream of the detection region in the high-pressure region; and (g) a means for carrying out the determination of abnormal balls based on the detection information of projecting portions of the balls obtained by the projecting ball-detecting means.

The apparatus for detecting and removing abnormal balls among a large number of balls, most of which are good separate balls, according to a further embodiment of the present invention comprises (a) a rotatable, ball-holding belt means comprising a large number of ball-receiving cavities each constituted by a through-hole for receiving one ball; (b) a pair of pulleys for rotatably supporting the ball-holding belt means; (c) a flat plate disposed immediately under a horizontal portion of an upper half of the ball-holding belt means, a surface of the ball-holding belt means being slidable over the flat plate; (d) a means for detecting part of a ball projecting from each ball-receiving cavity in a detection region on the flat plate; (e) a ball-supplying means disposed on the ball-holding belt means upstream of the detection region on the flat plate; (f) an abnormal ball-removing means disposed on the ball-holding belt means downstream of the detection region on the flat plate; (g) a means for collecting good separate balls disposed at a rear end of the flat plate; and (h) a means for carrying out the determination of abnormal balls based on the detection information of projecting portions of the balls obtained by the projecting ball-detecting means.

The apparatus for detecting and removing abnormal balls among a large number of balls, most of which are good separate balls, according to a further embodiment of the present invention comprises (a) a rotatable, ball-holding belt means comprising a large number of ball-receiving cavities each receiving one ball; (b) a pair of different-diameter pulleys for rotatably supporting the ball-holding belt means, a center of a larger-diameter pulley being positioned higher than a center of a smaller-diameter pulley; (c) a means for detecting part of a ball projecting from each ball-receiving cavity in a detection region substantially at a top of the larger-diameter pulley; (d) a ball-supplying means disposed a upstream of the detection region on the ball-holding belt means on the larger-diameter pulley; (e) an abnormal ball-removing means disposed downstream of the detection region on the ball-holding belt means on the larger-diameter pulley; (f) a means for collecting good separate balls disposed downstream of the detection region; and (g) a means for carrying out the determination of abnormal balls based on the detection information of projecting portions of the balls obtained by the projecting ball-detecting means.

DESCRIPTION OF THE PREFERRED EMBODIMENTS

The abnormal ball-detecting apparatuses and method according to embodiments of the present invention will be explained in detail below referring to the attached drawings. For the simplicity of explanation, connected balls are mostly taken as examples of abnormal balls, though the present invention is not limited thereto.

[1] Abnormal Ball-detecting Apparatus

Figure 1:
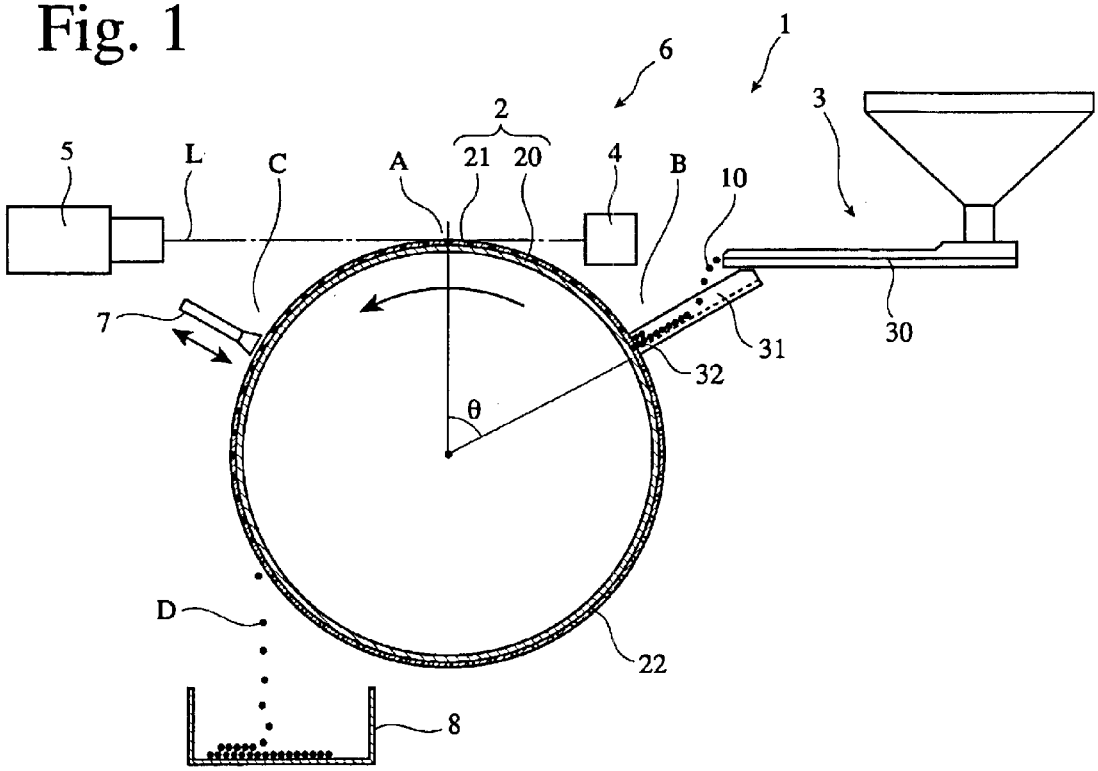
FIG. 1 is a schematic cross-sectional view showing the abnormal ball-detecting apparatus according to one embodiment of the present invention.

FIG. 1 is a schematic view showing an abnormal ball-detecting apparatus according to one embodiment of the present invention. The abnormal ball-detecting apparatus 1 comprises a ball-holding means 2 rotating in a direction shown by the arrow, a ball-supplying means 3 disposed around the ball-holding means 2, and a projecting ball-detecting means 6 comprising a light source 4 and a light receptor 5. The abnormal ball-detecting apparatus 1 in this embodiment is also equipped with a means 7 for removing abnormal balls such as connected balls, etc. from the ball-holding means 2, and a container 8 for collecting good separate balls.

In the above abnormal ball-detecting apparatus 1, balls 10 are continuously supplied from the ball-supplying means 3 to a supply region B on the surface of the ball-holding means 2 on the upstream side of a top thereof with respect to its rotation direction. Balls 10 held on the surface of the ball-holding means 2 are subjected to optical inspection by the projecting ball-detecting means 6, when they pass through the detection region A of the ball-holding means 2 substantially at a top thereof. At this time, if the balls 10 are abnormal balls such as connected balls, they partially project from the surface of the ball-holding means 2, whereby they are optically detected by the projecting ball-detecting means 6. Part of balls projecting from the ball-holding means 2 are optically detected by the projecting ball-detecting means 6.

Balls determined as connected balls are removed by a first ball-removing/collecting means 7 in a first ball-removing/collecting region C. In this embodiment, the first ball-removing/collecting means 7 is an abnormal ball-removing means, and the first ball-removing/collecting region C is an abnormal ball-removing region. Good separate balls remaining on the ball-holding means 2 fall into a second ball-removing/collecting means 8 and collected therein in a second ball-removing/collecting region D. In this embodiment, the second ball-removing/collecting means 8 is a container for collecting good separate balls, and the second ball-removing/collecting region D is a region for collecting good separate balls.

Unless otherwise mentioned, the first ball-removing/collecting region C is used as an abnormal ball-removing region, and the first ball-removing/collecting means 7 is used as an abnormal ball-removing means. Also, the second ball-removing/collecting region D is used as a region for collecting good separate balls, and the second ball-removing/collecting means 8 is used as a container for collecting good separate balls. It should be noted, however, that the present invention is not restricted thereto. For instance, the first ball-removing/collecting region C may be used as a region for collecting good separate balls, and the first ball-removing/collecting means 7 may be used as a means for collecting good separate balls. Also, the second ball-removing/collecting region D may be used as an abnormal ball-removing region, and the second ball-removing/collecting means 8 may be used as an abnormal ball-removing means. With these points in mind, the main members of the abnormal ball-detecting apparatus 1 will be explained in detail below.

(1) Ball-holding Means

Figure 2:
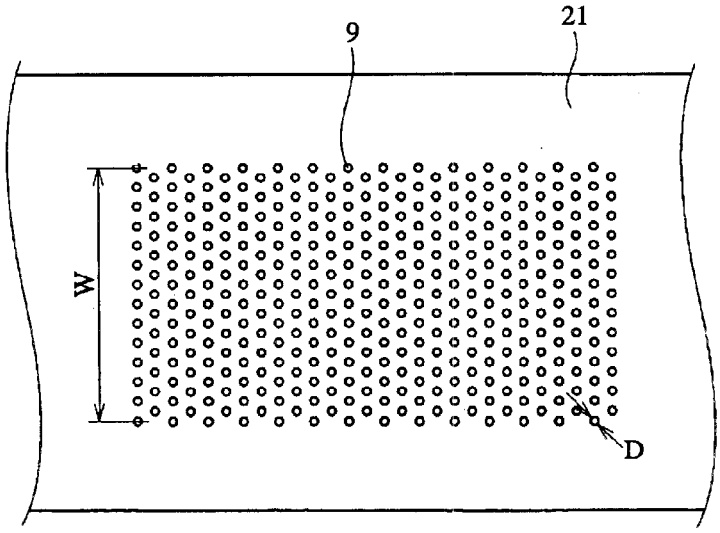
FIG. 2 is a plan view showing an apertured sheet member used in the abnormal ball-detecting apparatus of the present invention.

The ball-holding means 2 comprises a rotatable cylindrical member 20 and an apertured sheet member 21 attached to a flat outer surface of the cylindrical member 20. The apertured sheet member 21 is a sheet member made of a material such as metals, resins or rubbers, which is provided with a large number of through-holes 9 by etching, laser machining, mechanical machining, etc. as shown in FIG. 2. The through-holes 9 are arranged in a regular pattern such as a staggering or lattice pattern, etc. such that their positions are expressed digitally. Because the apertured sheet member 21 is closely attached to an outer surface of the cylindrical member 20, the outer surface of the cylindrical member 20 constitutes the bottom of each through-hole 9. As a result, the ball-holding means 2 has a large number of cavities 22 each receiving a ball 10 on the surface.

Figure 3:
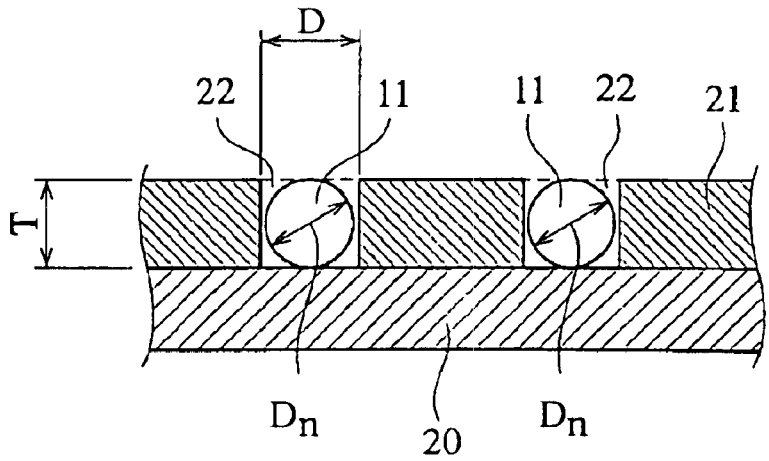
FIG. 3 is an enlarged cross-sectional view showing ball-receiving cavities in which separate balls exist.

FIG. 3 is an enlarged partial cross-sectional view showing ball-receiving cavities 22 into which good separate balls 11 have entered. As shown in FIG. 3, each ball-receiving cavity 22 has such a dimension that a good separate ball 11 is received without substantial gap horizontally and vertically.

Specifically, the thickness T of the apertured sheet member 21 is set substantially equal to the nominal diameter Dn of the good separate ball 11, and the diameter D of the through-hole 9 of the apertured sheet member 21 is set slightly larger than the nominal diameter Dn of the good separate ball 11. How much the diameter D of the through-hole 9 should be larger than the nominal diameter Dn may be determined by the permitted tolerance of the abnormal balls to be detected. Also, the thickness T of the apertured sheet member 21 may be determined, taking into consideration the dimensional tolerance of good separate balls 11, the tolerance of the thickness T of the apertured sheet member 21, the mounting precision of the cylindrical member 20, the specification of connected balls to be detected, a processing method for detecting abnormal balls, etc. For instance, when the thickness T of the apertured sheet member 21 is set slightly smaller than the nominal diameter Dn of good separate balls 11, even the standard good separate balls 11 are likely to be detected as connected balls. On the other hand, when the thickness T of the apertured sheet member 21 is set slightly larger than the nominal diameter Dn of good separate balls 11, small connected different-diameter balls are less likely to be detected. For the simplicity of explanation, it is assumed in this embodiment that the depth of the ball-receiving cavity 22, which is determined by the thickness T of the apertured sheet member 21, is the same as the nominal diameter Dn of balls.

The ball-holding means 2 is not restricted to those comprising a cylindrical member 20, but may have a structure in which the same apertured sheet member 202 as above is attached to, for instance, a flat plate 201, such that it moves reciprocally. Also, instead of forming the ball-receiving cavity 22 with a combination of the cylindrical member 20 and the apertured sheet member 21, the ball-receiving cavity 22 may be a recess having the predetermined depth, which is formed on the surface of the cylindrical member 20.

Figure 5:
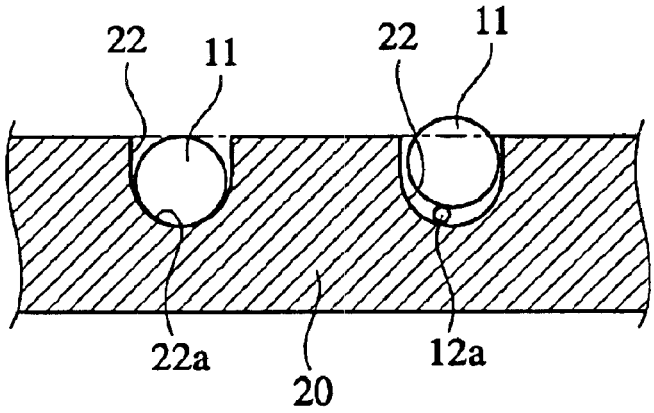
FIG. 5 is an enlarged cross-sectional view showing ball-receiving cavities each having a spherical bottom.
Figure 6:
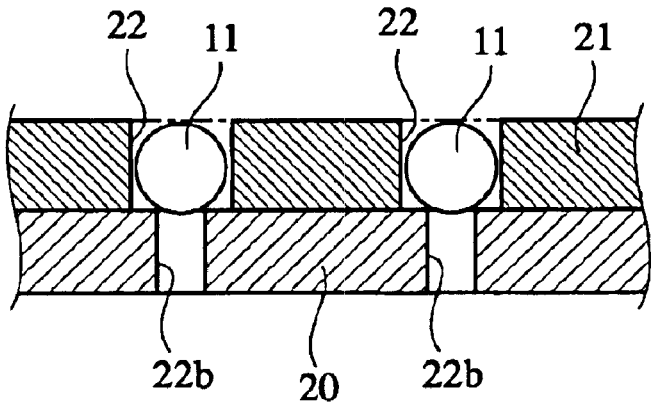
FIG. 6 is an enlarged cross-sectional view showing ball-receiving cavities each having a bottom having a through-hole.

The bottom of the ball-receiving cavity 22 may have a flat surface or a curved surface 22*a* having substantially the same curvature as the good separate ball 11 as shown in FIG. 5. In the case of the curved surface 22*a*, a small ball 12*a* does not sneak under a good separate ball 11 without being detected. Also, as shown in FIG. 6, the bottom of each ball-receiving cavity 22 may be provided with a through-hole 22*b* having such a size that a small ball 12*a* of less than the predetermined diameter falls therethrough. When these through-holes 22*b* are provided in the cylindrical member 20, the apertured sheet member 21 should be positioned precisely relative to the cylindrical member 20, such that each through-hole 22*b* of the cylindrical member 20 is located on the bottom of each through-hole 9 of the apertured sheet member 21.

Figure 7:
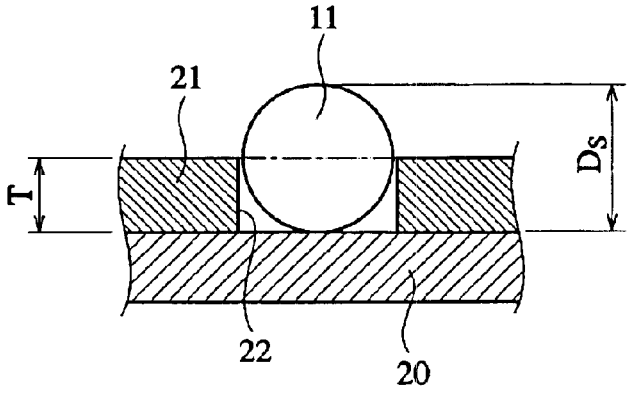
FIG. 7 is an enlarged cross-sectional view showing an example of a ball-receiving cavity for receiving a ball having a larger diameter than the depth of the ball-receiving cavity.

FIG. 7 shows an example of a ball-receiving cavity 22 in which a separate ball 11 having a larger diameter Dn than the depth T of the ball-receiving cavity 22 enters. Because even a good separate ball 11 projects from the ball-receiving cavity 22, the extent of projection of the ball is analyzed by image processing to determine whether it is an abnormal ball or not.

Figure 8:
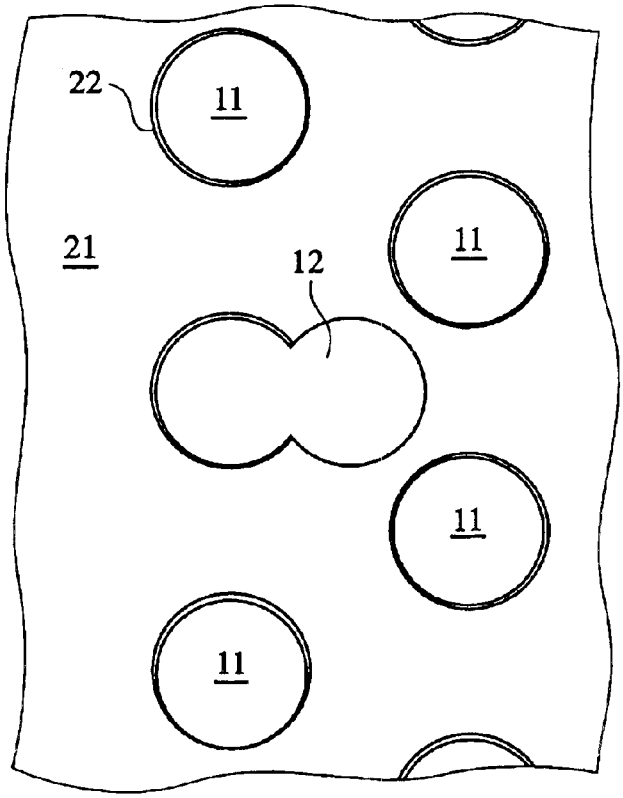
FIG. 8 is a plan view showing ball-receiving cavities of FIG. 7, one of which receives a connected ball.

FIG. 8 shows the ball-receiving cavities 22 of FIG. 7 in which not only a separation ball 11 but also a connected ball 12 exist. Because the ball-receiving cavities 22 in FIG. 7 are shallow, the connected ball 12 is likely to lie on its side on the apertured sheet member 21. Because a ball in the connected ball 12 projecting from the ball-receiving cavity 22 may be substantially in parallel with the light axis L of the projecting ball-detecting means 6, the connected ball 12 may not be detected precisely only with the projecting ball-detecting means 6. Accordingly, it is preferable to take the image of balls from above the apertured sheet member 21 to determine the presence of connected balls 12 by image processing.

(2) Ball-supplying Means

The ball-supplying means 3 disposed on the upstream side of the detection region A at the top of the ball-holding means 2 with respect to the rotation direction comprises, for instance, a vibration feeder 30 and a shoot 31 having a U-shaped cross section and connected to the vibration feeder 30. The shoot 31 is positioned such that its tip end is located close to the surface of the apertured sheet member 21, and the shoot 31 has such a width that a row W of the ball-receiving cavities 22 (see FIG. 2) is included. Therefore, a region surrounded by the tip portion of the shoot 31 and the apertured sheet member 21 constitutes a reservoir 32 for a large number of balls 10. The tip end of the shoot 31 is preferably located at a position about 45°–60° separate from the top of the ball-holding means 2 in a clockwise direction.

Balls 10 supplied from the vibration feeder 30 through the shoot 31 stay in the reservoir 32, where they enter into vacant ball-receiving cavities 22 coming successively according to the rotation of the ball-holding means 2. Because the axis of the ball-receiving cavity 22 is vertical when arriving at the detection region A, the ball 10 in the ball-receiving cavity 22 is surely in contact with a bottom thereof. Accordingly, standard separate balls 11 having diameters within the predetermined dimensional tolerance range would not project from the surface of the apertured sheet member 21 over the predetermined level.

(3) Projecting Ball-detecting Means

The projecting ball-detecting means 6 comprises a light source 4 for emitting a light beam toward the detection region A on the ball-holding means 2, and a light receptor 5 disposed in opposite to the light source 4 via the detection region A to optically detect portions of balls projecting from the surface of the apertured sheet member 21. The light source 4 is disposed such that its light axis L is in alignment with the tangent line direction of the outer surface of the ball-holding means 2. Though a light beam emitted from the light source 4 may be a scattered light beam, it is preferably a directional light beam for making clear image of projecting portions of the balls, particularly a laser beam. The light receptor 5 may be a position sensor detector (PSD), a CCD camera or a line sensor.

When no balls are projecting from the surface of the apertured sheet member 21, the light beam emitted from the light source 4 is received a by the light receptor 5 without being hindered by the balls, thereby generating bright pixels in the light-receiving element of the receptor 5. On the other hand, when balls are projecting from the surface of the apertured sheet member 21, the light beam emitted from the light source 4 is intercepted by the balls, thereby generating dark pixels in the light-receiving element of the light receptor 5. Accordingly, the processing of bright pixels and dark pixels can determine which balls are abnormal balls.

Though the depth of the ball-receiving cavity 22 is substantially the same as the nominal diameter Dn of the good separate balls 11, the balls are permitted to have diameters with the predetermined dimensional tolerance (usually several $\mu$m to ten and several $\mu$m in the case of solder balls). Accordingly, even good separate balls 11 within the predetermined dimensional tolerance project to some extent from the ball-receiving cavity 22 as long as their sizes are in a range from the nominal diameter Dn to the permitted maximum dimension. Thus, it is possible to determine that those balls are not abnormal balls as long as their projection from the ball-receiving cavity 22 are within the dimensional tolerance, by reducing the optical sensitivity of the light receptor 5 such that such projecting balls are not detected, or by setting a computer program such that they are not determined as abnormal balls.

The sensitivity of the projecting ball-detecting means 6 can be controlled, for instance, (a) by increasing the projection extent of balls necessary for turning one pixel into a "bright" state depending on the conditions of balls to be detected, how to detect abnormal balls, etc.; or (b) by setting high the criterion of brightness of a pixel at which the pixel is determined as bright or dark, or the threshold level of an electric signal; (c) by reducing the intensity of a light beam emitted from the light source 4, etc. However, to detect balls projecting over the predetermined level with high precision, it is preferable not to decrease the sensitivity of the projecting ball-detecting means 6.

(4) Abnormal Ball-Determining Processing

Whether or not a certain ball is an abnormal ball such as connected balls, etc. is determined by whether or not there are pixels corresponding to a projecting portion of a ball optically detected by the light receptor 5 of the projecting ball-detecting means 6. However, depending on the control conditions of the optical sensitivity of the light receptor 5, some good separate balls 11 with large dimensional tolerance may be detected as abnormal balls even though they are good separate balls 11 within the predetermined dimensional tolerance. Also, depending on the dimensional tolerance of the depth of the ball-receiving cavity 22, the depth of some ball-receiving cavities 22 may be smaller than the permitted minimum dimension of the good separate balls 11. In such cases, even standard good separate balls 11 project from the surface of the apertured sheet member 21 over the predetermined tolerance. Accordingly, an abnormal ball-determining means (not shown) is preferably connected to the light receptor 5 to carry out the determination of abnormal balls based on signals output from the light receptor 5.

Figure 9:
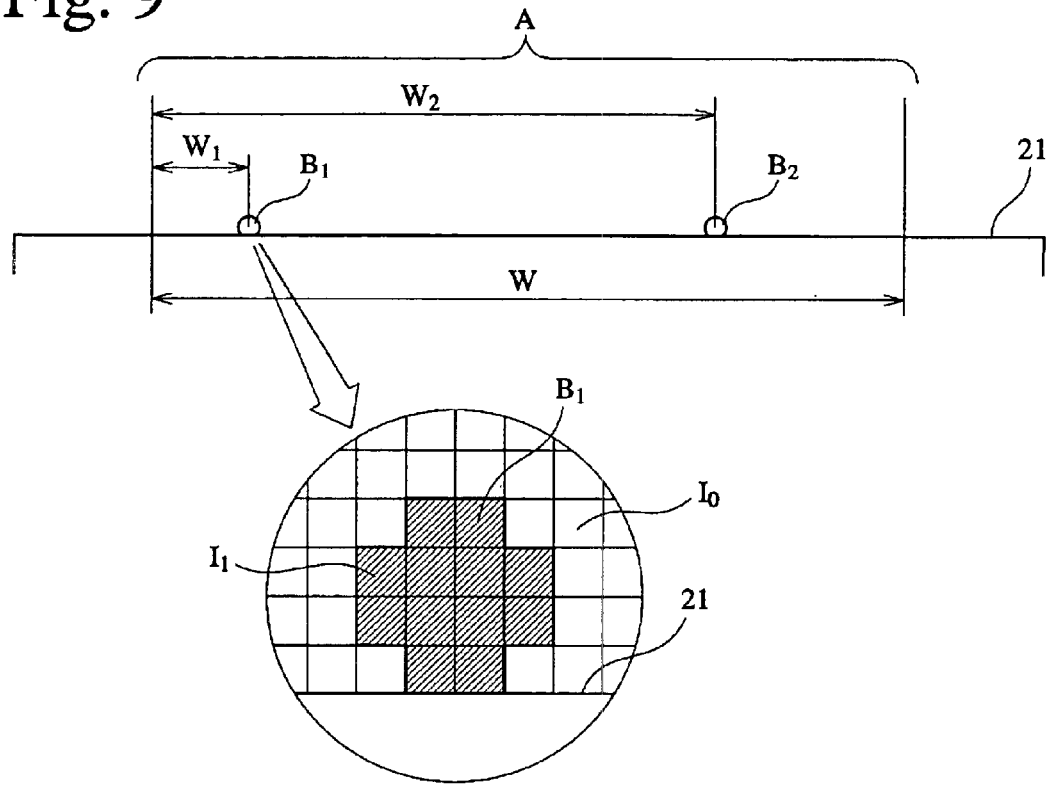
FIG. 9 is a schematic view showing a method for determining which balls in the ball-receiving cavities of the ball-holding means are abnormal balls and a method for determining the positions of the abnormal balls.

To determine the abnormal balls, pixels generated by the optical detection of projecting portions of balls by the light receptor 5 may be subjected to image processing. As shown in FIG. 9, for instance, pixels on the apertured sheet member 21 in the detection region A are linearly aligned in the width direction of the apertured sheet member 21, with bright pixels $I_0$ in areas where no balls are projecting, and with a plurality of dark pixels $I_1$ in areas where balls are projecting over the predetermined level. Because a plurality of dark pixels $I_1$ form the image of a projecting portion of each ball as shown in an enlarged view in FIG. 9, the number, height or area, etc. of dark pixels in that portion are calculated to determine that the ball is an abnormal ball $B_1$ such as connected balls, etc. when they exceed reference levels. Because abnormal balls $B_1$, $B_2$ appear on the apertured sheet member 21 in its width direction, it is possible to determine the positions of the abnormal balls $B_1$, $B_2$ to be removed, by calculating their distances $W_1$, $W_2$ from the reference position (for instance, left side of a row W of the ball-receiving cavities 22) on the apertured sheet member 21.

When a laser beam is projected, an optical system for receiving interference fringes can be used to detect projecting portions of balls by the change of the interference fringes. When the balls are not projecting, the interference fringes appear linearly in parallel with the surface of the apertured sheet member 21. On the other hand, when the balls are projecting, the interference fringes are largely deflected in portions where the projecting balls exist. By the method utilizing interference fringes, a means 6 for detecting projecting portions of balls has a high sensitivity, so that it can detect even small projecting portions of balls. The determination of whether or not a particular ball is an abnormal ball can be carried out by using an abnormal ball-determining means, for instance, according to the procedure of counting the number of interference fringes in a portion where there is an abnormal ball, and comparing that number with the reference number of interference fringes in a portion where no ball is projecting.

When balls 10 entering into the ball-receiving cavities 22 are good separate balls 11 as shown in FIG. 3, the balls 10 do not project from the surface of the apertured sheet member 2 beyond the predetermined level. On the other hand, when balls 10 entering into the ball-receiving cavities 22 are connected balls 13 such as connected identical-diameter balls as shown on the right side in FIG. 4, part thereof are projecting from the surface of the apertured sheet member 21, so that they can be detected by the projecting ball-detecting means 6. However, in the case of the connected different-diameter balls 12 constituted by a small ball 12*a* attached to a large ball 12*b* as shown on the left side in FIG. 4, when the small ball 12*a* is so small that it enters between the large ball 12*b* and the wall of the ball-receiving cavity 22, the small ball 12*a* may not project from the surface of the apertured sheet member 21 depending on its position.

Figure 4:
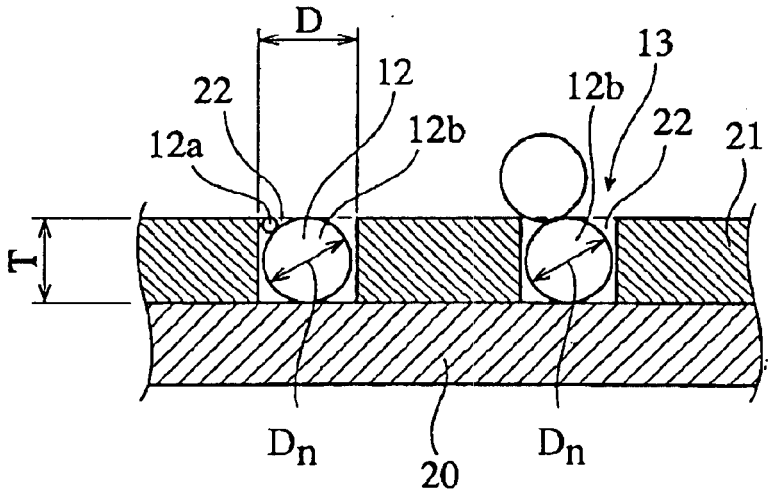
FIG. 4 is an enlarged cross-sectional view showing ball-receiving cavities in which connected balls exist.

Assuming that the diameter D of the ball-receiving cavity 22 is the same as the nominal diameter Dn of the balls 10 in FIG. 4, the maximum diameter of the small ball 12*a*, which does not project from the surface of the apertured sheet member 21, is found to be about 0.17 times the diameter Dn of the large ball 12*b*, which is the same as a good separate ball 11, by geometric calculation. The connected different-diameter balls 12, in which a small ball 12*a* has a diameter less than 0.17 times the diameter of a large ball 12*b*, may not project from the ball-receiving cavity 22 depending on its direction in the ball-receiving cavity 22, so that it is not detected by the projecting ball-detecting means 6. Accordingly, taking into consideration that the diameter D of the ball-receiving cavity 22 should be slightly larger than the nominal diameter Dn of the balls 10, in addition to the permitted range of the dimensional tolerance of balls 10, the detecting precision of the projecting ball-detecting means 6, etc., a small ball 12*a* in the connected different-diameter balls 12 can be found as an abnormal ball with high reliability, when it has a diameter of 0.2 times or more that of a large ball 12*b*.

Though it is desirable that the balls 10 include no connected balls at all, there may often be no problem from the practical point of view some even if connected different-diameter balls 12 containing small-diameter balls 12*a* are included. For instance, in the case of solder balls, etc., small balls 12*a* having diameters up to 0.3 times the nominal diameter Dn of large balls 12*b* may usually be included. In order that connected different-diameter balls comprising small balls 12*a* having diameters more than 0.3 times the diameters of large balls 12*b* are surely projecting from the surface of the apertured sheet member 21, it is found from geometric calculation that the diameter D of the ball-receiving cavity 22 should be about 1.2 times or less the nominal diameter Dn of the balls 10. In other words, in order that the balls 10 are easily received in the ball-receiving cavities 22, the diameter D of each ball-receiving cavity 22 may be as large as up to about 1.2 times the nominal diameter Dn of the balls 10. Thus, the diameter D of each ball-receiving cavity 22 can be determined depending on the sizes of small balls 12*a* permitted in the connected different-diameter balls 12. Incidentally, the opening of each ball-receiving cavity 22 is not necessarily restricted to a true circular shape having a diameter D, but may be, for instance, in an elliptical or elongated circular shape having larger long axis and short axis than the nominal diameter Dn.

When projecting portions of balls are not detected by the projecting ball-detecting means 6, the balls 10 in the detection region A are either good separate balls 11 or connected different-diameter balls 12 comprising extremely small balls 12*a*, though both of them may be determined as good separate balls. On the other hand, when projecting portions of balls are detected, those balls 10 may immediately be determined as abnormal balls, or the signals of the projecting ball-detecting means 6 may be output to an abnormal ball-determining means (not shown), where they are determined as abnormal balls. Which processing method is used may be determined based on the conditions of balls to be detected, detection procedures, the precision of a detecting apparatus, the sensitivity of the projecting ball-detecting means 6, etc. Here, the "abnormal ball" is not limited to connected balls having a small ball exceeding the permitted size, but includes a separate ball with foreign matter and a separate ball outside the permitted tolerance range of size and sphericity.

When the ball-holding means 22 is sufficiently shallower than the height of a single ball 11 as shown in FIGS. 7 and 8, for instance, the processing of balls'image by computer software can determine whether or not a projecting portion of a ball is sufficiently higher than (Dn−T), and thus whether or not the ball is an abnormal ball. With this result combined with the results obtained by processing the image of balls taken from above the apertured sheet member 21, more precise determination of the presence of a connected ball.

[2] Separation Operation and Collection Operation

When the projecting ball-detecting means 6 or the abnormal ball-determining means determines that there are abnormal balls to be removed such as connected balls, etc., it provides an abnormal ball-detecting signal to separate abnormal balls (defective balls) from good separate balls. For instance, the abnormal ball-removing means 7 is disposed in an abnormal ball-removing region C downstream of the detection region A, and the operation of the abnormal ball-removing means 7 is controlled by the abnormal ball-detecting signal. For instance, with a robot having a suction hand as the abnormal ball-removing means 7 and provided with information concerning the positions of abnormal balls in a width direction of the surface of the ball-holding means 2, only the abnormal balls can be removed. When the ball-holding means 2 is rotated at a higher speed to increase the detection speed, it is difficult to suck only abnormal balls by a suction means. Accordingly, separate balls around the abnormal ball may be sucked together. Because the percentage of the abnormal balls is extremely small, such method contributes to increase in the detection speed without sacrificing the detection yield.

Balls 10 (good separate balls) remaining on the ball-holding means 2 after passing the abnormal ball-removing region C are collected in a container 8 disposed in a good separate ball-collecting region D below the ball-holding means 2. Incidentally, by sucking good separate balls by a suction means, for instance, it is not necessary that the good separate ball-collecting region D is disposed downstream of the abnormal ball-removing region C.

When the percentage of abnormal balls is extremely small, all balls 10 including abnormal balls in a row in the width direction of the apertured sheet member 21 may be removed. In this case, the light source 4 and the light receptor 5 of the projecting ball-detecting means 6 may be disposed in the width direction of the ball-holding means 2, such that they oppose via the detection region A. Also, the container 8 may be exchanged to an abnormal ball-collecting container at a time when an abnormal ball moves to the good separate ball-collecting region D, so that a group of balls including the abnormal ball fall into the abnormal ball-collecting container. The abnormal ball can be removed manually after stopping the rotation of the ball-holding means 2 and alarming by a lamp, etc. Alternatively, to collect only good separate balls surely, good separate balls may first be taken out by suction in the abnormal ball-removing region C, and the remaining balls may then be collected as abnormal balls in the good ball-collecting region D.

Figure 10:
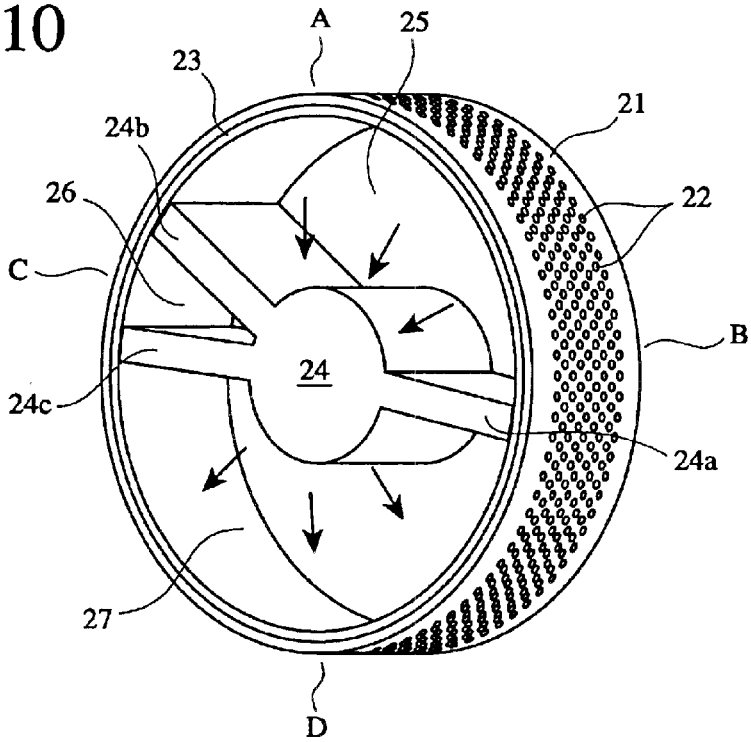
FIG. 10 is a perspective view showing another example of ball-holding means.

FIG. 10 shows a ball-holding means according to another embodiment of the present invention. Incidentally, sidewalls are omitted to show the internal structure of the ball-holding means in FIG. 10. To surely introduce and remove balls 10 into and from ball-receiving cavities 22, this ball-holding means 2 comprises a cylindrical member 23 equipped with an apertured sheet member 21, a stationary member 24 having three rib portions 24*a*, 24*b*, 24*c* and disposed inside the cylindrical member 23, each of the rib portions 24*a*, 24*b*, 24*c* having a tip end in contact with the inner surface of the cylindrical member 23 in a substantially air-tight manner. A region surrounded by the inner surface of the cylindrical member 23 and the two rib portions 24*a*, 24*b* is a reduced-pressure region 25, a region surrounded by the inner surface of the cylindrical member 23 and the two rib portions 24*b*, 24*c* is an atmospheric-pressure region 26, and a region surrounded by the inner surface of the cylindrical member 23 and the two rib portions 24*a*, 24*c* is a high-pressure region 27. In order that the apertured sheet member 21 is communicatable with the inside of the cylindrical member 23, the cylindrical member 23 is preferably formed by a porous material such as a sintered metal, etc. Alternatively, the cylindrical member 23 is preferably provided with a large number of small holes in alignment with the ball-receiving cavities 22.

Figure 11:
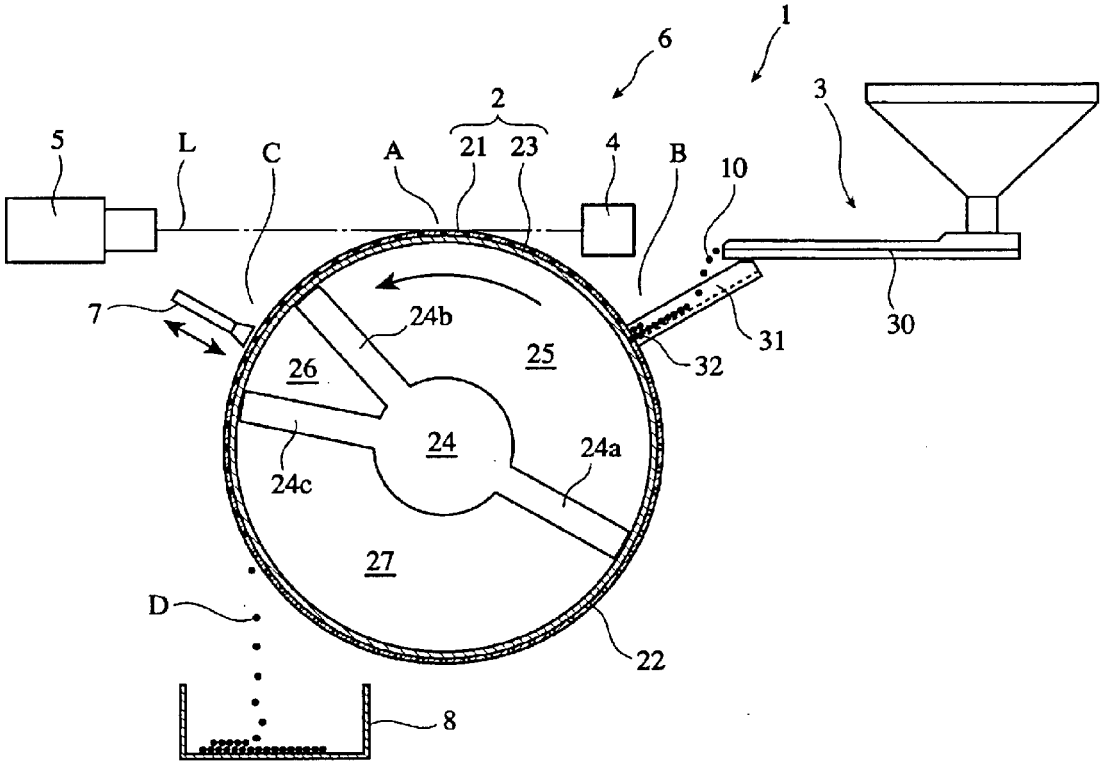
FIG. 11 is a perspective view showing an abnormal ball-detecting apparatus comprising the ball-holding means of FIG. 10.

FIG. 11 shows an example in which the ball-holding means 21 shown in FIG. 10 is equipped with a ball-supplying means 3, a projecting ball-detecting means 6, an abnormal ball-removing means 7, and a container 8 for collecting good separate balls. In a region extending from a supply region B of balls 10 to a region before an abnormal ball-removing region C, the inside of the cylindrical member 23 is at a negative pressure, whereby suction force is applied to the ball-receiving cavities 22 to make the introduction of the balls 10 into the ball-receiving cavity 22 easily, and to surely hold the balls 10 in the ball-receiving cavity 22. In the abnormal ball-removing region C, the inside of the cylindrical member 23 returns to an atmospheric pressure, so that neither suction force nor high pressure is applied to the ball-receiving cavities 22. As a result, the balls 10 are easily removed. In a region D for collecting good separate balls, high-pressure is applied from the cylindrical member 23 to the ball-receiving cavities 22, so that the balls 10 can surely be discharged.

Figure 12:
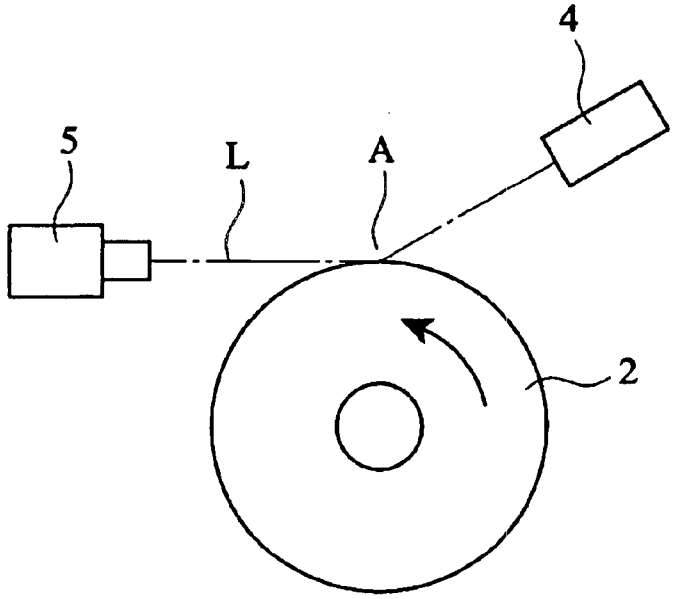
FIG. 12 is a schematic view showing another example of a projecting ball-detecting means in the abnormal ball-detecting apparatus.

As shown in FIG. 1, instead of using a passing light beam for the purpose of detecting balls 10, a reflected light beam may be used to detect portions of balls 10 projecting from the ball-receiving cavities 22. FIG. 12 schematically shows an example in which a light source 4 emits a slit light beam to a detection region A in a range extending along the width of the ball-holding means 2, and light beams reflected by balls 10 in the ball-receiving cavities 22 are received by a light receptor 5. The light receptor 5 is arranged such that its light axis L is substantially in accordance with the tangent line of the ball-holding means 2 in the detection region A. The light source 4 is arranged such that a slit light beam is projected from above in a slanting direction on the opposite side of the light receptor 5 to the detection region A. The light beam from the light source 4 is preferably a highly directional light beam, particularly a laser beam.

Figure 13:
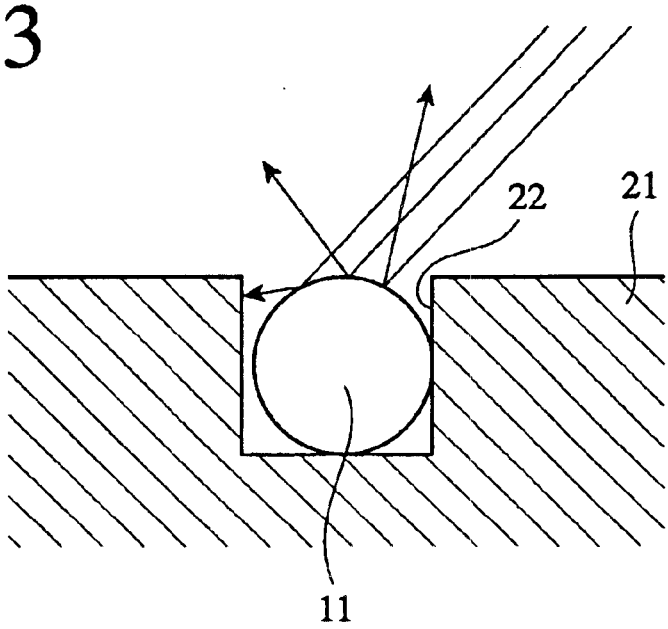
FIG. 13 is an enlarged cross-sectional view showing a ball-receiving cavity in which a good separate ball exists in the projecting ball-detecting means of FIG. 12.
Figure 14:
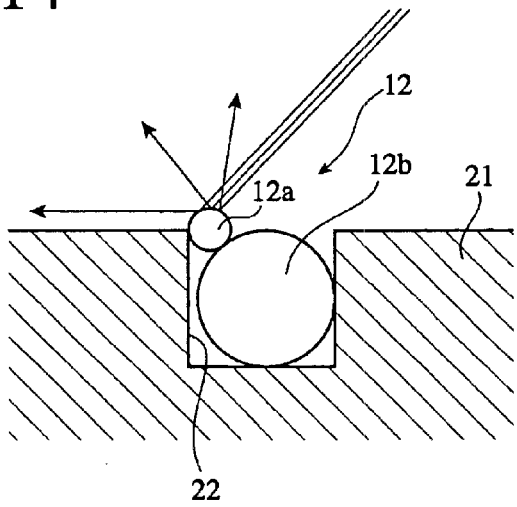
FIG. 14 is an enlarged cross-sectional view showing a ball-receiving cavity in which a connected ball exists in the projecting ball-detecting means of FIG. 12.

When a separate ball 11 is not projecting from a ball-receiving cavity 22 as shown in FIG. 13, in the arrangement of the light receptor 5 and the light source 4 shown in FIG. 12, an incident light beam is reflected by a radiated surface of the ball 11 at the same angle as the angle of incidence, so that a reflected light beam in a direction to the light receptor 5 is blocked by the wall of the ball-receiving cavity 22. As a result, no reflected light beam enters into the light receptor 5. On the other hand, in the case of connected different-diameter balls 12 comprising a large ball 12*b* and a small ball 12*a* as shown in FIG. 14, with the small ball 12*a* projecting from the ball-receiving cavity 22, part of the light beam reflected from the small ball 12*a* enters into the light receptor 5. Because the reflected light beam is highly bright, it is possible to surely detect a projecting portion of the small ball 12*a*. Incidentally, even a separate ball 11 projecting from the ball-receiving cavity 22 as above can be made undetectable as long as it is within the dimensional tolerance, by lowering brightness or an electrical signal level below the predetermined threshold level by a filter in hardware or computer software, etc. The light receptor 5 and the light source 4 may be arranged at opposite positions.

Figure 15:
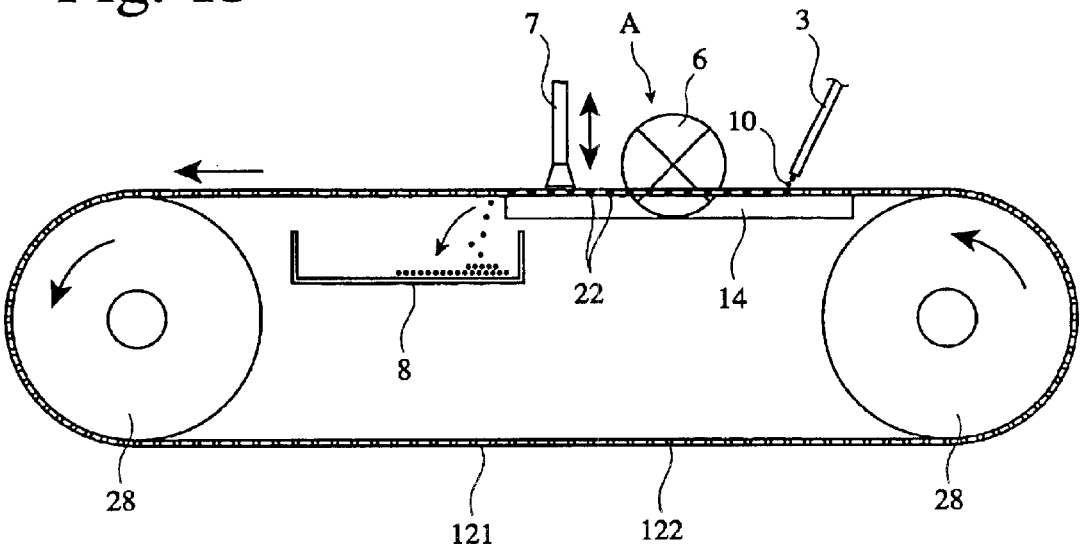
FIG. 15 is a schematic cross-sectional view showing an abnormal ball-detecting apparatus according to a further embodiment of the present invention.

FIG. 15 shows an abnormal ball-detecting apparatus according to a still further embodiment of the present invention. Incidentally, the same reference numerals are assigned to the same parts in FIG. 15 as in FIG. 1. In this the abnormal ball-detecting apparatus, an apertured belt member 121 is an endless belt having a large number of through-holes 122. The apertured belt member 121 is wound around a pair of pulleys 28, 28, one of which is connected to a driving means (not shown). The apertured belt member 121 slidably moves on the surface of the flat plate 14 fixed at the predetermined position. The through-holes 122 of the apertured belt member 121 are provided with bottoms on the flat plate 14, thereby acting as ball-receiving cavities 22. A ball-supplying means 3, a projecting ball-detecting means 6, an abnormal ball-removing means 7 and a container 8 for collecting good separate balls are disposed in this order from upstream in a region on the flat plate 14.

Balls 10 supplied from the ball-supplying means 3 enter into the ball-receiving cavities 22 of the apertured belt member 121 and move to a projecting ball-detecting region A. A light source 4 and a light receptor 5 of the projecting ball-detecting means 6 are disposed in the width direction of the apertured belt member 121 in the projecting ball-detecting region A. Accordingly, when an abnormal ball is detected, all balls in a row including that abnormal ball are removed by the abnormal ball-removing means 7 disposed downstream. The abnormal ball-removing means 7 per se may be the same as shown in FIG. 1. Because the bottoms of the ball-receiving cavities 22 are open downstream of the rear end of the flat plate 14 downstream of the abnormal ball-removing means 7, good separate balls fall into the container 8.

Figure 16:
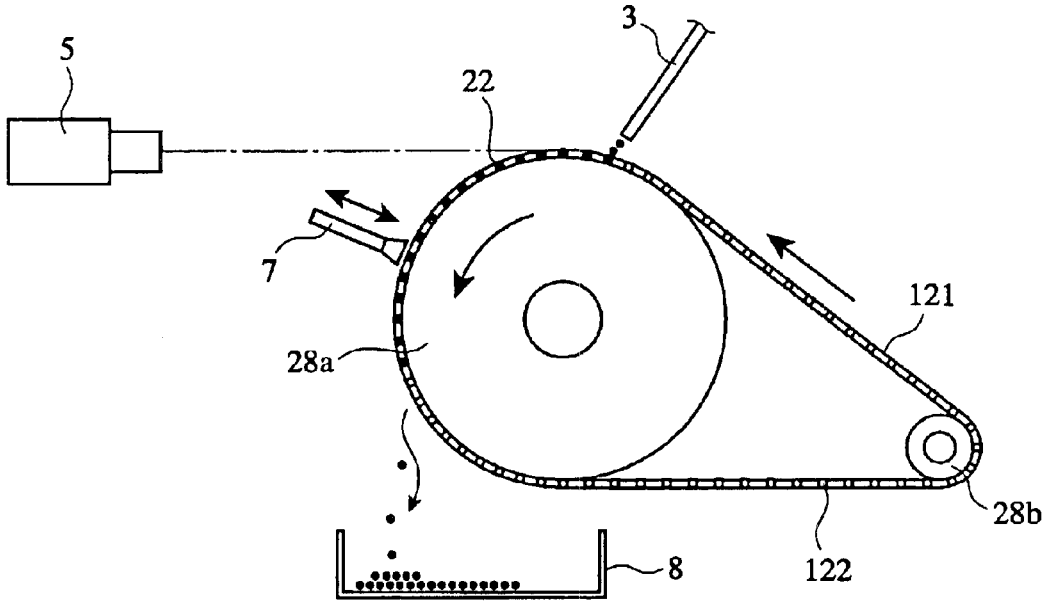
FIG. 16 is a schematic cross-sectional view showing an abnormal ball-detecting apparatus according to a still further embodiment of the present invention.

FIG. 16 shows an abnormal ball-detecting apparatus according to a still further embodiment of the present invention. An apertured belt member 121 having a large number of through-holes 122 are wound around a larger-diameter pulley 28*a* and a smaller-diameter pulley 28*b*, one of which is connected to a driving apparatus (not shown). The through-holes 122 have closed bottoms on the larger-diameter pulley 28*a*, thereby acting as ball-receiving cavities 22. Because the center of the larger-diameter pulley 28*a* is positioned higher than the center of the smaller-diameter pulley 28*b*, a ball-supplying means 3, a projecting ball-detecting means 5, an abnormal ball-removing means 7 and a container 8 for collecting good separate balls can be disposed in the same manner as in FIG. 1. The detection operation of abnormal balls by this abnormal ball-detecting apparatus is substantially the same as that of the abnormal ball-detecting apparatus shown in FIG. 1.

Figure 17:
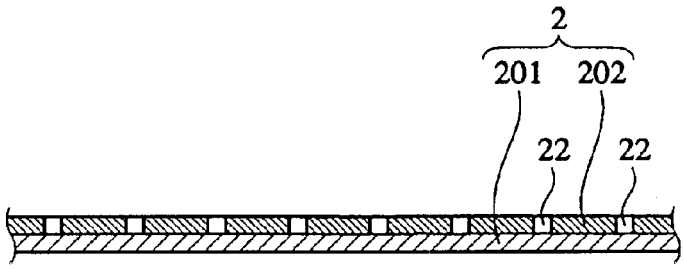
FIG. 17 is a schematic cross-sectional view showing a ball-holding means usable in the abnormal ball-detecting apparatuses shown in FIGS. 13 and 14.

FIG. 17 shows a ball-holding means 2 having a structure in which an apertured belt member 202 is attached to a flat surface of a belt member 201. This ball-holding means 2may be used in the abnormal ball-detecting apparatus shown in FIGS. 15 and 16. Because this ball-holding means 2 is reinforced by the belt member 201, it has higher strength than that of a ball-holding means composed only of the apertured belt member 202.

Though the present invention has been explained above referring to the attached drawings, it is not restricted thereto, and various modifications can be made within the scope of the present invention. For instance, the ball-holding means may be stationary, while the projecting ball-detecting means is movable.

Though the ball-receiving cavity of the ball-holding means has the same depth as the nominal diameter of the good separate balls in the above embodiment, the depth of the ball-receiving cavity may be slightly smaller or larger than the diameters of the good separate balls, depending on the permitted range of dimensional tolerance. Also, when small balls of the connected balls have entered into the ball-receiving cavities, they cannot be detected by a passing light beam or a reflected light beam. Therefore, it is preferable to take image from above the ball-receiving cavities in the detection region, to detect small balls of the predetermined diameter (for instance, 0.3 times the diameter of each large ball) or more.

As described in detail above, because the abnormal ball-detecting apparatus of the present invention has a structure in which a large number of small balls are received in ball-receiving cavities one by one, and portions of balls projecting from the ball-receiving cavities are optically detected to determine whether or not they are abnormal balls, the detection of abnormal balls can be carried out with high reliability. Also, because each ball projecting from each ball-receiving cavity is determined as to whether or not it is an abnormal ball, the detection of abnormal balls is accurate. Further, because abnormal balls are separated based on abnormal ball-determining signals, abnormal balls can automatically be separated from good separate balls in a large number of balls. The abnormal ball-detecting apparatus and method of the present invention having such features are suitable for solder balls, bearing balls, etc.

Though the abnormal ball-detecting apparatus and method of the present invention are effective to detect connected balls among balls from which balls having sizes outside the predetermined range are removed by a sieve, the present invention is not restrictive thereto, and may be used for the purpose of detecting other abnormal balls than connected balls.

What is claimed is:

1. An apparatus for detecting abnormal balls among a large number of balls, most of which are good separate balls, comprising a ball-holding means having a large number of ball-receiving cavities each receiving one ball, a means for detecting whether parts of balls project a pre-determined distance from a surface of said ball-holding means, and a means for carrying out the determination of said abnormal balls by utilizing detection information of said projecting parts of said balls.

2. An apparatus for detecting abnormal balls among a large number of balls, most of which are good separate balls, comprising a ball-holding means having a large number of ball-receiving cavities each receiving one ball, a means for detecting parts of balls projecting from a surface of said ball-holding means, and a means for carrying out the determination of abnormal balls based on detection information of said projecting parts of said balls.

3. The abnormal ball-detecting apparatus according to claim 1, further comprising a means for separating balls determined as abnormal balls from good separate balls.

4. The abnormal ball-detecting apparatus according to claim 2, further comprising a means for separating balls determined as abnormal balls from good separate balls.

5. The abnormal ball-detecting apparatus according to claim 1, wherein said ball-receiving cavity has a depth substantially equal to and a diameter slightly larger than a diameter of each good separate ball.

6. The abnormal ball-detecting apparatus according to claim 2, wherein said ball-receiving cavity has a depth substantially equal to and diameter slightly larger than a diameter of each good separate ball.

7. The abnormal ball-detecting apparatus according to claim 5, wherein said ball-holding means comprises an apertured sheet member having a thickness substantially equal to the diameter of each good separate ball and through-holes each having as large a diameter as 1 to 1.2 times the diameter of each good separate ball, and a support member having a flat surface attached to said apertured sheet member, said ball-receiving cavities being formed by said through-holes of said apertured sheet member and said support member.

8. The abnormal ball-detecting apparatus according to claim 6, wherein said ball-holding means comprises an apertured sheet member having a thickness substantially equal to the diameter of each good separate ball and through-holes each having as large a diameter as 1 to 1.2 times the diameter of each good separate ball, and a support member having a flat surface attached to said apertured sheet member, said ball-receiving cavities being formed by said through-holes of said apertured sheet member and said support member.

9. The abnormal ball-detecting apparatus according to claim 1, wherein said projecting ball-detecting means comprises a light source for emitting a light beam toward said ball-receiving cavities, and a light receptor for receiving a light beam passing over the surface of each ball-receiving cavity, and wherein when part of a ball is projecting from a ball-receiving cavity, said light beam is intercepted the by detecting that said ball is projecting the pre-determined distance from the surface of said ball-receiving cavity.

10. The abnormal ball-detecting apparatus according to claim 2, wherein said projecting ball-detecting means comprises a light source for emitting a light beam toward said ball-receiving cavities, and a light receptor for receiving a light beam passing over the surface of each ball-receiving cavity, and wherein when part of a ball is projecting from a ball-receiving cavity, said light beam is intercepted thereby detecting that said ball is projecting the pre-determined distance from the surface of said ball-receiving cavity.

11. The abnormal ball-detecting apparatus according to claim 1, wherein said projecting ball-detecting means comprises a light source for emitting a light beam toward said ball-receiving cavities, and a light receptor for receiving a light beam reflected from part of a ball from a ball-receiving cavity, thereby detecting that said ball is projecting the pre-determined distance from the surface of said ball-receiving cavity.

12. The abnormal ball-detecting apparatus according to claim 2, wherein said projecting ball-detecting means comprises a light source for emitting a light beam toward said ball-receiving cavities, and a light receptor for receiving a light beam reflected from part of a ball projecting from a ball-receiving cavity, thereby detecting that said ball is projecting the pre-determined distance from the surface of said ball-receiving cavity.

13. A method for detecting abnormal balls among a large number of balls, most of which are good separate balls, said method comprising introducing balls into cavities, each having a predetermined depth, optically detecting whether part of a ball projects a pre-determined distance for a surface of each cavity, and carrying out the determination of abnormal balls by a determination logic utilizing detection information of said balls.

14. A method for detecting abnormal balls among a large number of balls, most of which are good separate balls, said method comprising introducing balls into cavities each having substantially a same depth as a diameter of each good separate ball; optically detecting part of a ball projecting from a surface of said cavity; and determining balls projecting more than a reference level as abnormal balls.

15. An apparatus for detecting and removing abnormal balls among a large number of balls, most of which are good separate balls, comprising (a) a rotatable, cylindrical, ball-holding means comprising a large number of ball-receiving cavities each receiving one ball; (b) a means for detecting whether part of a ball projects a pre-determined distances from a surface of each ball-receiving cavity in a detection region substantially at a top of said cylindrical bail-holding means; (c) a ball-supplying means disposed upstream of said detection region on said cylindrical ball-holding means; (d) an abnormal ball-removing means disposed on said cylindrical ball-holding means downstream of said detection region; (e) a means for collecting good separate balls downstream of said detection region; and (f) a means for carrying out the determination of abnormal balls based on the detection information of said projecting parts of said balls obtained by said projecting ball-detecting means.

* * * * *

UNITED STATES PATENT AND TRADEMARK OFFICE

CERTIFICATE OF CORRECTION

PATENT NO. : 6,818,849 B2
DATED : November 16, 2004
INVENTOR(S) : Motoyuki Itou et al.

It is certified that error appears in the above-identified patent and that said Letters Patent is hereby corrected as shown below:

Column 2,
Line 9, “parts of balls projecting from a” should read -- whether parts of balls project a pre-determined distance from a --.

Column 15,
Line 25, “and diameter” should read -- and a diameter --.
Line 53, “the by” should read -- thereby --.

Column 16,
Line 46, “bail-holding” should read -- ball-holding --.

Signed and Sealed this

Fifth Day of April, 2005

JON W. DUDAS
*Director of the United States Patent and Trademark Office*